US008702973B2

(12) United States Patent
Costello et al.

(10) Patent No.: US 8,702,973 B2
(45) Date of Patent: Apr. 22, 2014

(54) PROCESS FOR UPGRADING ONE OR MORE HYDROCARBONS BOILING IN A NAPHTHA RANGE

(75) Inventors: Colleen Costello, Chicago, IL (US); Suheil F. Abdo, Lincolnshire, IL (US); Keith Adrian Holder, Lightwater (GB); Ashley James Austin, Camberley (GB); Willie J. Morrissette, Jr., Bolingbrook, IL (US)

(73) Assignee: UOP LLC, Des Plaines, IL (US)

( * ) Notice: Subject to any disclaimer, the term of this patent is extended or adjusted under 35 U.S.C. 154(b) by 260 days.

(21) Appl. No.: 13/048,863

(22) Filed: Mar. 15, 2011

(65) Prior Publication Data

US 2012/0234729 A1 Sep. 20, 2012

(51) Int. Cl.

| | |
|---|---|
| ***C10G 45/08*** | (2006.01) |
| ***C10G 45/02*** | (2006.01) |
| ***C10G 45/04*** | (2006.01) |

(52) U.S. Cl.

USPC ..... 208/208 R; 208/209; 208/216 R; 208/217; 502/100; 502/208; 502/210; 502/211; 502/213

(58) Field of Classification Search

USPC ..... 208/216 R, 208 R, 217, 177, 209, 213; 502/100, 208, 210, 211, 213

See application file for complete search history.

(56) References Cited

U.S. PATENT DOCUMENTS

| | | | | |
|---|---|---|---|---|
| 5,474,670 | A * | 12/1995 | Daage et al. | 208/210 |
| 5,503,734 | A | 4/1996 | Fletcher et al. | |
| 5,525,211 | A | 6/1996 | Sudhakar et al. | |
| 5,851,382 | A | 12/1998 | Sudhakar | |
| 6,303,020 | B1 | 10/2001 | Podrebarac et al. | |
| 6,984,312 | B2 | 1/2006 | Som et al. | |
| 7,556,729 | B2 | 7/2009 | Bhan et al. | |
| 7,815,792 | B2 | 10/2010 | Bauer et al. | |
| 2008/0073250 | A1 | 3/2008 | Bakshi | |

FOREIGN PATENT DOCUMENTS

| | | | |
|---|---|---|---|
| JP | 4938179 | B2 * | 3/2001 |
| JP | 04938178 | B2 | 5/2012 |
| WO | 2004041971 | Al | 5/2004 |

OTHER PUBLICATIONS

Habibi, S, Update hydrotreating methods for LPG, Hydrocarbon Processing, 2007, July Issue, pp. 75-77.*

(Continued)

*Primary Examiner* — Walter D Griffin

*Assistant Examiner* — Derek Mueller

(74) *Attorney, Agent, or Firm* — James C Paschall

(57) ABSTRACT

One exemplary embodiment can be a process for upgrading one or more hydrocarbons boiling in a naphtha range including less than about 5%, by weight, one or more alkenes and about 2,000-about 5,000 wppm, S, comprised in one or more sulfur-containing compounds, based on the weight of the one or more hydrocarbons. The process can include contacting the one or more hydrocarbons with a catalyst. The catalyst may include about 0.1-about 10%, by weight, NiO, about 5-about 50%, by weight, $MoO_3$, and about 0.1-about 10%, by weight, P, with the balance of the catalyst comprising $Al_2O_3$. The process can obtain an upgraded one or more hydrocarbons having a thiol concentration of no more than about 20 wppm, S, based on the sulfur comprised in one or more thiol compounds divided by the weight of the upgraded one or more hydrocarbons.

20 Claims, 2 Drawing Sheets

(56) References Cited

OTHER PUBLICATIONS

Parkash, S, Refining Processes Handbook, 2003, Elvesier, pp. 29-38.*

Romero et al., "H2S and Promoter (CO, NI) Effects on Molybdenum Based Catalysts for Selective HDS of FCC Gasoline", American Chemical Society, Division of Petroleum Chemistry, Inc. Preprints, Aug. 2008, vol. 53, No. 2, pp. 5-8.

Yin et al., "Hydrodesulfurization of Cracked Naphtha Over Zeolite-Supported Ni-Mo-S Catalysts", Applied Catalysis A: General, Oct. 8, 2004, vol. 273, No. 1-2, pp. 177-184.

* cited by examiner

PROCESS FOR UPGRADING ONE OR MORE HYDROCARBONS BOILING IN A NAPHTHA RANGE

FIELD OF THE INVENTION

This invention generally relates to a process for upgrading one or more hydrocarbons boiling in a naphtha range.

DESCRIPTION OF THE RELATED ART

The conversion of thiols to hydrogen sulfide and the corresponding paraffins in hydrotreating units can typically be carried out with one of a variety of catalysts in the presence of hydrogen. Generally, the choice of the catalyst can depend on the feed characteristics, the nature of the sulfur compounds in the feed, and the process conditions. In naphtha hydrotreating units, catalysts often contain compounds of cobalt and molybdenum. Particularly, a cobalt molybdenum catalyst is usually considered to be superior to a nickel molybdenum catalyst due to past experience with superior operations. However, there have been difficulties desulfurizing natural gas condensates boiling in a naphtha range where the unit is unable to meet sulfur specifications. Particularly, the olefins in the hydrotreating unit effluent can recombine with hydrogen sulfide to reform thiol compounds. As a consequence, the effluent can have an undesirable level of thiol compounds.

Due to increasing regulatory requirements, there is a desire to produce an effluent with a low content of sulfur compounds. As a consequence, there is a desire to operate the unit to produce such an effluent.

SUMMARY OF THE INVENTION

One exemplary embodiment can be a process for upgrading one or more hydrocarbons boiling in a naphtha range including less than about 5%, by weight, one or more alkenes and about 2,000-about 5,000 wppm, S, comprised in one or more sulfur-containing compounds, based on the weight of the one or more hydrocarbons. The process can include contacting the one or more hydrocarbons with a catalyst. The catalyst may include about 0.1-about 10%, by weight, NiO, about 5-about 50%, by weight, $MoO_3$, and about 0.1-about 10%, by weight, P, with the balance of the catalyst including $Al_2O_3$. The process can obtain an upgraded one or more hydrocarbons having a thiol concentration of no more than about 20 wppm, S, based on the sulfur comprised in one or more thiol compounds divided by the weight of the upgraded one or more hydrocarbons.

Another embodiment can be a process for upgrading one or more hydrocarbons. The process can include contacting a feed including hydrogen and one or more hydrocarbons boiling in a naphtha range. The one or more hydrocarbons may include less than about 5%, by weight, one or more alkenes and about 2,000-about 5,000 wppm, S, comprised in one or more sulfur-containing compounds based on the weight of the one or more hydrocarbons. The feed may be contacted with a catalyst including about 0.1-about 10%, by weight, NiO, about 5-about 50%, by weight, $MoO_3$, and about 0.1-about 10%, by weight, P, with the balance of the catalyst including $Al_2O_3$. An upgraded one or more hydrocarbons, having a thiol concentration of no more than about 20 wppm, S, based on the sulfur comprised in one or more thiol compounds divided by the weight of the upgraded one or more hydrocarbons, may be obtained.

Yet a further exemplary embodiment can be a process for upgrading one or more hydrocarbons. The process can include contacting a feed including one or more hydrocarbons boiling in a naphtha range. The one or more hydrocarbons may include less than about 5%, by weight, one or more alkenes and about 2,000-about 5,000 wppm, S, comprised in one or more sulfur-containing compounds based on the weight of the one or more hydrocarbons with a catalyst to obtain an upgraded one or more hydrocarbons. The catalyst may include about 0.1-about 10%, by weight, NiO, about 5-about 50%, by weight, $MoO_3$, and about 0.1-about 10%, by weight, P, with the balance of the catalyst including $Al_2O_3$.

The embodiments disclosed herein can provide a nickel molybdenum catalyst that can operate at low pressure. Surprisingly, the nickel molybdenum catalyst can provide superior performance at low pressure as compared to a cobalt molybdenum catalyst. Generally, this result is surprising and unexpected as past performance would suggest the use of a cobalt molybdenum catalyst at low pressure, as a cobalt molybdenum catalyst is expected to provide at east equal, if not better, performance than a nickel molybdenum catalyst. However, the recombination of olefins in the hydrotreating unit effluent with hydrogen sulfide can create an elevated level of thiol compounds when utilizing a cobalt molybdenum catalyst. As a consequence, it would be preferable to operate the unit with a nickel molybdenum catalyst that can provide lower levels of thiol compounds in an effluent. Although not wanting 0.0 be bound by theory, it is believed that the nickel molybdenum catalyst hydrogenates olefins more quickly or forms fewer olefins, and hence less thiol compounds due to recombination in the effluent.

DEFINITIONS

As used herein, one or more hydrocarbon molecules may be abbreviated C1, C2, C3 . . . Cn where "n" represents the number of carbon atoms in the one or more hydrocarbon molecules. Furthermore, a superscript "+" or "−" may be used with an abbreviated one or more hydrocarbons notation, e.g., $C3^+$ or $C3^-$, which is inclusive of the abbreviated one or more hydrocarbons. As an example, the abbreviation "$C3^+$" means one or more hydrocarbon molecules of three carbon atoms and/or more.

As used herein, the term "upgraded one or more hydrocarbons" means processed one or more hydrocarbons including converted and unconverted hydrocarbons.

As used herein, the terms "paraffins" and "alkanes" may be used interchangeably.

As used herein, the terms "olefins" and "alkenes" may be used interchangeably.

As used herein, the terms "thiols", "mercaptans", and "thiol compounds" may be used interchangeably.

As used herein, the term "sulfur" may be abbreviated "S" and used interchangeably with its abbreviation.

As used herein, the term "nickel oxide" may be abbreviated "NiO" and used interchangeably with its abbreviation.

As used herein, the term "molybdenum oxide" may be abbreviated "$MoO_3$" and used interchangeably with its abbreviation.

As used herein, the term "phosphorus" may be abbreviated "P" and used interchangeably with its abbreviation.

As used herein, the term "aluminum oxide" may be abbreviated "$Al_2O_3$" and used interchangeably with its abbreviation.

As used herein, the term "weight parts per million" may be abbreviated "wppm".

As used herein, sulfur and thiol concentrations can be reported as "weight percent" or "wppm", and be measured according to ASTM D5453-09 for the feed and hydrogenated effluent.

DETAILED DESCRIPTION

Figure 1:
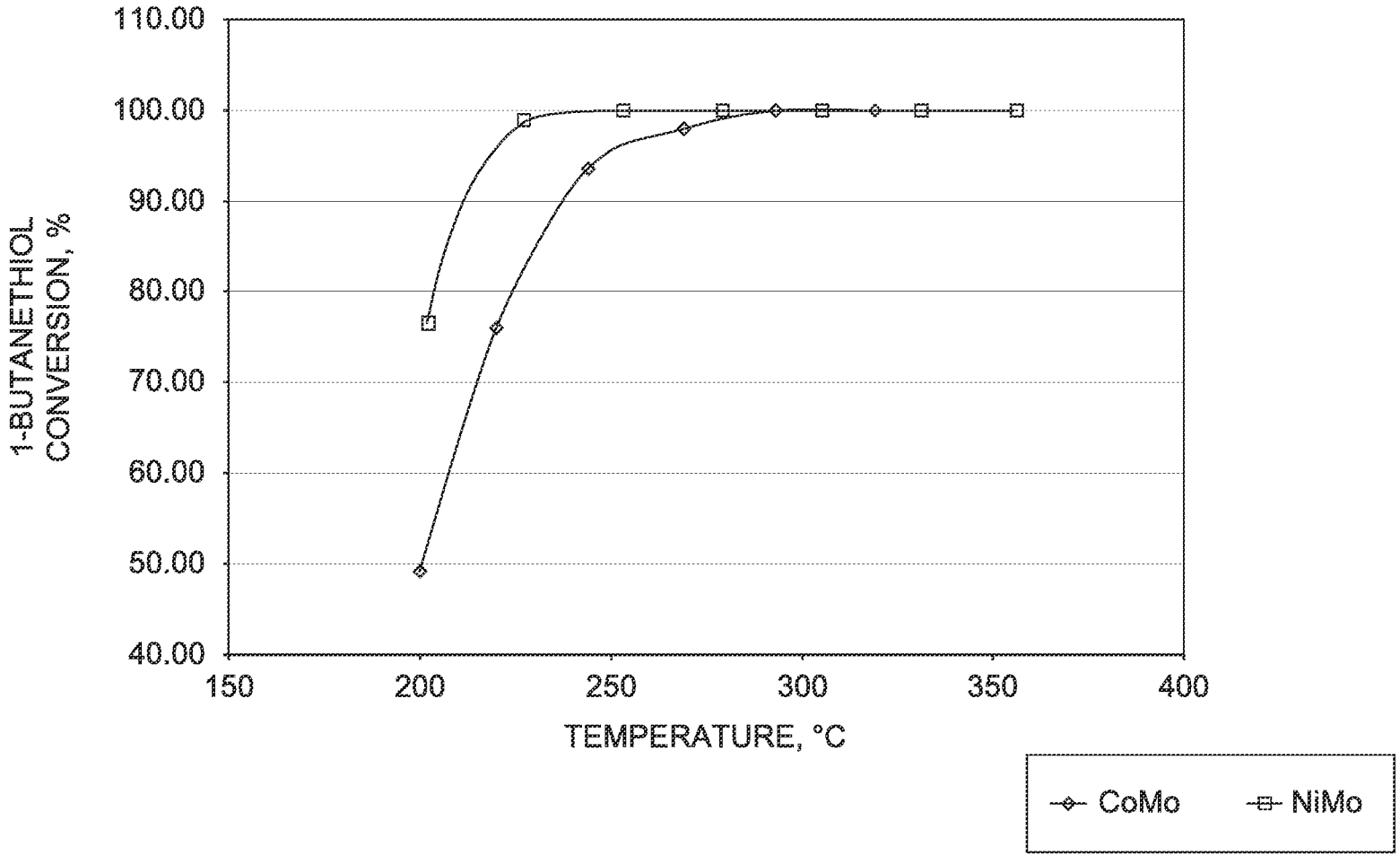
FIG. 1 is a graphical depiction of 1-butanethiol conversion percent versus temperature in degrees Celsius.

Not wanting to be bound by theory, it is believed that the decomposition of thiols by hydrotreating can follow one of two pathways. Namely, the decomposition can proceed by 1) removal of sulfur from the thiol compound to form hydrogen sulfide and the corresponding olefin followed by hydrogenation of the olefin to form a corresponding paraffin; or 2) direct conversion of the thiol compound to hydrogen sulfide and the corresponding paraffin without the intermediate formation of an olefin. If hydrogen sulfide levels are sufficiently high and decomposition occurs via the first pathway, it is possible that the olefins may recombine with the hydrogen sulfide to form one or more thiol compounds, which can be typical of C5 and up to C10 compounds. This reformation of thiol compounds can result in a hydrotreated product that cannot meet the specified sulfur levels.

The embodiments herein can enable the hydrotreatment of a feed including one or more hydrocarbons boiling in a naphtha range. Usually, the feed is a naphtha. Generally, the feed can have less than about 5%, by weight, of one or more olefins and about 2,000-about 5,000 wppm, preferably about 1,000-about 2,000 wppm, sulfur, including one or more sulfur containing compounds based on the weight of the feed. Alternatively, the feed can include no more than about 4%, preferably no more than about 3%, even no more than about 2%, or no more than about 1%, by weight, of one or more olefins based on the weight of the feed. In other exemplary embodiments, the feed can include no more than about 1,000 wppm or even about 100 wppm, olefins, based on the weight of the feed. In yet further exemplary embodiments, the feed can include about 100 wppm-about 5%, by weight, of one or more olefins based on the weight of the feed. The one or more hydrocarbons can have a boiling point in a naphtha range, which is typical of C5 compounds. The end point may be up to about 210° C. Generally, the one or more hydrocarbons can boil with not less than about 10% of the one or more hydrocarbons below 175° C. and not less than about 95% of the one or more hydrocarbons below 240° C. Typically, the one or more hydrocarbons can include natural gas condensates, and usually include one or more C4-C9 hydrocarbons.

Generally the feed can include about 2,000-about 5,000 wppm, preferably about 1,000-about 2,000 wppm, sulfur, comprised of one or more sulfur containing compounds based on the weight of the feed. These one or more sulfur containing compounds can include at least one of hydrogen sulfide, sulfur dioxide, carbonyl sulfide, methane thiol, ethane thiol, dimethyl sulfide, propane-2-thiol, 2-methyl-propane-2-thiol, ethyl methyl sulfide, butane-2-thiol, 2-methyl propane-1-thiol, methyl isopropyl sulfide, diethyl sulfide, butane-1-thiol, t-amyl thiol, t-butyl methyl sulfide, dimethyl disulfide, n-butyl methyl sulfide, ethyl isopropyl sulfide, ethyl n-propyl sulfide, 3-methyl-butane-1-thiol, 2-methyl-butane-1-thiol, di-isopropyl sulfide, t-butyl ethyl sulfide, pentane-1-thiol, ethyl methyl disulfide, 2-ethyl thiophene, isopropyl propyl sulfide, 3-ethyl thiophene, 2,5-dimethylthiophene, dipropyl sulfide, diethyl disulfide, hexane-1-thiol, octane-1-thiol, and methyl benzothiophene.

Usually, the feed is hydrotreated by contacting with a catalyst in the presence of hydrogen. The temperature of the contacting can be conducted at about 200-about 400° C., at a pressure of about 700-about 3,600 kPa, and a liquid hourly space velocity of about 2-about 10 $h^{-1}$. Generally, hydrogen is provided at a volumetric ratio of about 50-about 100 $m^3$ hydrogen per $m^3$ of the one or more hydrocarbons in the feed with the hydrogen volume calculated at standard temperature and pressure.

The catalyst can include about 0.1-about 10%, preferably about 1-about 5%, by weight, NiO, about 5-about 50%, preferably about 20-about 30%, by weight, $MoO_3$, and about 0.1-about 10% preferably about 1-about 5%, by weight, P, with the balance of the catalyst including $Al_2O_3$ or mostly $Al_2O_3$ based on the weight of the catalyst. Alternatively, the balance of the catalyst may include $SiO_2$, or $Al_2O_3$ and $SiO_2$. The catalyst can be used either alone or in conjunction with additional catalyst to affect removal of sulfur-containing compounds from the one or more hydrocarbons. Further, one or more other hydrotreating catalysts may be used instead. In one exemplary embodiment, the nickel molybdenum catalyst can be used alone or in conjunction with a cobalt molybdenum catalyst or other catalysts optionally in a stack configuration, which can include a sequential loading of one catalyst layer on top of another layer. Thus, the catalyst can include or comprise a plurality of catalysts arranged in a stacked configuration.

After hydrogenating, the effluent obtained can provide an upgraded one or more hydrocarbons having a thiol concentration of no more than and usually much less than about 20 wppm, sulfur, based on the sulfur comprised in the one or more thiol-containing compounds divided by the weight of the upgraded one or more hydrocarbons. The thiol concentration in units of wppm is determined by the formula:

$$\frac{1\times10^6\times\sum_i w(thiol)i\times\frac{\%\ S}{100}}{\text{total mass of product}}$$

where: w(thiol)i represents the mass of a thiol compound i in the product; and

% S represents the weight percent of sulfur in the thiol compound i. Generally, the upgraded one or more hydrocarbons can be comprised of a product including hydrogen sulfide, sulfur dioxide, and carbonyl sulfide at a concentration of about 2,000-about 5,000 wppm, sulfur, comprised in one or more sulfur containing compounds based on the weight of the upgraded one or more hydrocarbons. The operating conditions can depend on a specific unit and feed composition, and may be determined as needed.

ILLUSTRATED EMBODIMENTS

The following examples are intended to further illustrate the subject embodiments. These illustrations of embodiments of the invention are not meant to limit the claims of this invention to the particular details of these examples. These examples are based on engineering calculations and actual operating experience with similar processes.

The downstream recombination of hydrogen sulfide with one or more olefins can be prevented through the use of a catalyst that ensures complete hydrogenation of the olefins thereby preventing the formation of thiols under suitable operating conditions. Cobalt molybdenum catalysts can typically be used in naphtha hydrotreating units. During testing with a simulated naphtha feed spiked with 1-butanethiol, olefins are detected in the product stream over a temperature range of 200-325° C., even though these conditions are generally believed to promote complete hydrogenation of the olefins. Only at 350° C. did the level of olefins in the product fall below the detectable limit with the cobalt molybdenum catalyst. Elevated levels of 2-butanethiols are also observed, suggesting the incomplete hydrogenation of the olefins resulting in some recombination of the hydrogen sulfide to form thiols. Utilizing a nickel molybdenum catalyst, complete olefin hydrogenation at 250° C. and higher temperatures can be achieved.

Referring to FIG. 1, the percent conversion of nickel molybdenum catalyst versus cobalt molybdenum catalyst is compared. Two tests are ran at the same conditions with measurements being taken at various temperatures between 175-450° C. and 2,520 kPa with a simulated naphtha feed including the following composition as depicted in the Table below:

TABLE 1

| Feed Component | Mole Fraction |
|---|---|
| Hydrogen Sulfide | 0.003 |
| Hydrogen | 0.289 |
| n-Hexane | 0.198 |
| Toluene | 0.185 |
| Benzene | 0.200 |
| Methylcyclopentane | 0.057 |
| 3-Methylpentane | 0.040 |
| 2-Methylpentane | 0.022 |
| 1-Butanethiol | 0.006 |

Figure 2:
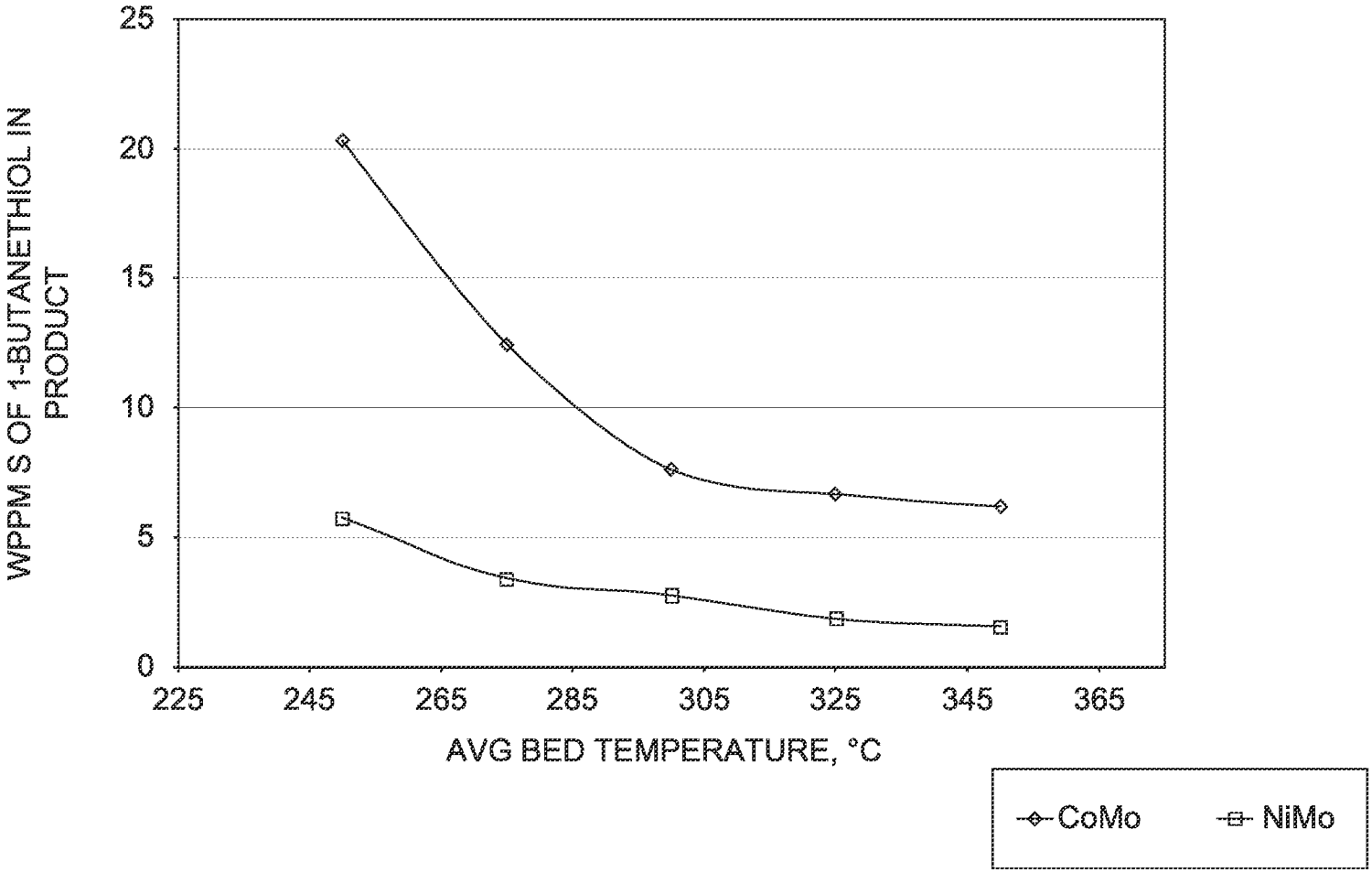
FIG. 2 is weight ppm of sulfur of 1-butanethiol in product versus average bed temperature in degrees Celsius.

As depicted in FIG. 1, it is evident that the conversion of 1-butanethiol occurs at a higher level at a lower temperature for the nickel molybdenum catalyst than cobalt molybdenum catalyst. Referring to FIG. 2, samples are again taken at temperatures of 245-365° C. Again, the nickel molybdenum catalyst shows significantly lower levels of residual 1-butanethiol in the product as compared to cobalt molybdenum catalyst at corresponding temperatures. The difference is most profound at lower temperatures.

Thus, the nickel molybdenum catalyst provides improved results as compared to a cobalt molybdenum catalyst in light of a naphtha feed spiked with 1-butanethiol. Thus, these results indicate that a nickel molybdenum catalyst can effectively prevent the recombination of hydrogen sulfide with olefins by ensuring the complete hydrogenation of olefins produced by thiol decomposition. Use of this catalyst in a hydrotreating unit can prevent the reformation of thiols downstream better enabling the unit to meet product sulfur specifications. The nickel molybdenum catalyst can be used in low pressure hydrotreating units in place of a cobalt molybdenum catalyst, particularly if there are high initial thiol levels in the feed and high hydrogen sulfide levels in the reactor environment.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for upgrading one or more hydrocarbons boiling in a naphtha range comprising less than about 5%, by weight, one or more alkenes and about 2,000-about 5,000 wppm, S, comprised in one or more sulfur-containing compounds, based on the weight of the one or more hydrocarbons, comprising contacting the one or more hydrocarbons with a catalyst comprising:

1) about 0.1-about 10%, by weight, NiO;
2) about 5-about 50%, by weight, $MoO_3$; and
3) about 0.1-about 10%, by weight, P, with the balance of the catalyst comprising $Al_2O_3$;

to obtain an upgraded one or more hydrocarbons having a thiol concentration of no more than about 20 wppm, S, based on the sulfur comprised in one or more thiol compounds divided by the weight of the upgraded one or more hydrocarbons.

2. The process according to claim 1, wherein the contacting is conducted at a temperature of about 200-about 400° C. and a pressure of about 780-about 3,600 kPa.

3. The process according to claim 1, wherein the contacting is conducted at a liquid hourly space velocity of about 2-about 10 $h^{-1}$.

4. The process according to claim 1, wherein the catalyst comprises:

about 1-about 5%, by weight, NiO;
about 20-about 30%, by weight, $MoO_3$; and
about 1-about 5%, by weight, P, with the balance of the catalyst comprising $Al_2O_3$.

5. The process according to claim 1, wherein the one or more hydrocarbons comprises natural gas condensates.

6. The process according to claim 5, wherein hydrogen is provided at a volumetric ratio of about 50-about 100 $m^3$ hydrogen per $m^3$ of the one or more hydrocarbons with the hydrogen volume calculated at standard temperature and pressure.

7. The process according to claim 1, wherein the one or more sulfur-containing compounds comprises at least one of hydrogen sulfide, sulfur dioxide, carbonyl sulfide, methane thiol, ethane thiol, dimethyl sulfide, propane-2-thiol, 2-methyl-propane-2-thiol, ethyl methyl sulfide, butane-2-thiol, 2-methyl propane-1-thiol, methyl isopropyl sulfide, diethyl sulfide, butane-1-thiol, t-amyl thiol, t-butyl methyl sulfide, dimethyl disulfide, n-butyl methyl sulfide, ethyl isopropyl sulfide, ethyl n-propyl sulfide, 3-methyl-butane-1-thiol, 2-methyl-butane-1-thiol, di-isopropyl sulfide, t-butyl ethyl sulfide, pentane-1-thiol, ethyl methyl disulfide, 2-ethyl thiophene, isopropyl propyl sulfide, 3-ethyl thiophene, 2,5-dimethylthiophene, dipropyl sulfide, diethyl disulfide, hexane-1-thiol, octane-1-thiol, and methyl benzothiophene.

8. The process according to claim 1, wherein the one or more hydrocarbons comprises one or more $C_4$-$C_9$ hydrocarbons.

9. The process according to claim 1, wherein a thiol concentration of the one or more hydrocarbons is about 1,000-about 2,000 wppm, S, comprised in one or more thiol-containing compounds based on the weight of the one or more hydrocarbons.

10. The process according to claim 1, wherein the upgraded one or more hydrocarbons is comprised in a product comprising hydrogen sulfide, sulfur dioxide, and carbonyl sulfide at a concentration of about 2,000-about 5,000 wppm, S, comprised in one or more sulfur-containing compounds based on the weight of the upgraded one or more hydrocarbons.

11. A process for upgrading one or more hydrocarbons, comprising:

contacting a feed comprising hydrogen and one or more hydrocarbons boiling in a naphtha range wherein the one or more hydrocarbons comprises less than about 5%, by weight, one or more alkenes and about 2,000-about 5,000 wppm, S, comprised in one or more sulfur-containing compounds based on the weight of the one or more hydrocarbons, with a catalyst comprising:

1) about 0.1-about 10%, by weight, NiO;

2) about 5-about 50%, by weight, $MoO_3$; and 3) about 0.1-about 10%, by weight, P, with the balance of the catalyst comprising $Al_2O_3$;

to obtain an upgraded one or more hydrocarbons having a thiol concentration of no more than about 20 wppm, S, based on the sulfur comprised in one or more thiol compounds divided by the weight of the upgraded one or more hydrocarbons.

12. The process according to claim 11, wherein the contacting is conducted at a temperature of about 200-about 400° C. and a pressure of about 780-about 3,600 kPa.

13. The process according to claim 11, wherein the contacting is conducted at a liquid hourly space velocity of about 2-about 10 $h^{-1}$.

14. The process according to claim 11, wherein the catalyst comprises:

about 1-about 5%, by weight, NiO;

about 20-about 30%, by weight, $MoO_3$; and about 1-about 5%, by weight, P, with the balance of the catalyst comprising $Al_2O_3$.

15. The process according to claim 11, wherein the hydrogen is provided at a volumetric ratio of about 50-about 100 $m^3$ hydrogen per $m^3$ of the one or more hydrocarbons with the hydrogen volume calculated at standard temperature and pressure.

16. The process according to claim 11, wherein the one or more sulfur-containing compounds comprises at least one of hydrogen sulfide, sulfur dioxide, carbonyl sulfide, methane thiol, ethane thiol, dimethyl sulfide, propane-2-thiol, 2-methyl-propane-2-thiol, ethyl methyl sulfide, butane-2-thiol, 2-methyl propane-1-thiol, methyl isopropyl sulfide, diethyl sulfide, butane-1-thiol, t-amyl thiol, t-butyl methyl sulfide, dimethyl disulfide, n-butyl methyl sulfide, ethyl isopropyl sulfide, ethyl n-propyl sulfide, 3-methyl-butane-1-thiol, 2-methyl-butane-1-thiol, di-isopropyl sulfide, t-butyl ethyl sulfide, pentane-1-thiol, ethyl methyl disulfide, 2-ethyl thiophene, isopropyl propyl sulfide, 3-ethyl thiophene, 2,5-dimethylthiophene, dipropyl sulfide, diethyl disulfide, hexane-1-thiol, octane-1-thiol, and methyl benzothiophene.

17. The process according to claim 11, wherein the catalyst comprises a plurality of catalysts arranged in a stacked configuration.

18. A process for upgrading one or more hydrocarbons, comprising:

contacting a feed comprising one or more hydrocarbons boiling in a naphtha range wherein the one or more hydrocarbons comprises less than about 5%, by weight, one or more alkenes and about 2,000-about 5,000 wppm, S, comprised in one or more sulfur-containing compounds based on the weight of the one or more hydrocarbons, with a catalyst comprising:

1) about 0.1-about 10%, by weight, NiO;

2) about 5-about 50%, by weight, $MoO_3$; and 3) about 0.1-about 10%, by weight, P, with the balance of the catalyst comprising $Al_2O_3$;

to obtain an upgraded one or more hydrocarbons.

19. The process according to claim 18, wherein the contacting is conducted at a temperature of about 200-about 400° C. and a pressure of about 780-about 3,600 kPa.

20. The process according to claim 18, wherein the contacting is conducted at a liquid hourly space velocity of about 2-about 10 $h^{-1}$.

* * * * *